US009814272B2

(12) United States Patent
Li et al.

(10) Patent No.: US 9,814,272 B2
(45) Date of Patent: Nov. 14, 2017

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Changzheng Dai, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 15/275,331

(22) Filed: Sep. 23, 2016

(65) Prior Publication Data

US 2017/0006923 A1 Jan. 12, 2017

(30) Foreign Application Priority Data

Sep. 30, 2015 (CN) ..... 2015 2 0766159 U

(51) Int. Cl.
*A24F 25/02* (2006.01)
*A24F 47/00* (2006.01)
*B67D 99/00* (2010.01)

(52) U.S. Cl.
CPC ..... *A24F 47/008* (2013.01); *B67D 99/00* (2013.01)

(58) Field of Classification Search
CPC ..... A24F 25/02
USPC ..... 439/329, 330
See application file for complete search history.

(56) References Cited

U.S. PATENT DOCUMENTS

| | | | | |
|---|---|---|---|---|
| 9,675,118 | B2 * | 6/2017 | Chen | A24F 47/008 |
| 2015/0245661 | A1 * | 9/2015 | Milin | A24F 47/008 131/329 |
| 2016/0044963 | A1 * | 2/2016 | Saleem | A24F 47/008 131/328 |
| 2016/0073694 | A1 * | 3/2016 | Liu | H05B 3/40 131/329 |
| 2016/0143355 | A1 * | 5/2016 | Borges | A24F 47/006 131/329 |
| 2016/0165954 | A1 * | 6/2016 | Hovespian | A24F 47/008 131/329 |

* cited by examiner

*Primary Examiner* — Phuong Chi T Nguyen
(74) *Attorney, Agent, or Firm* — Cheng-Ju Chiang

(57) ABSTRACT

An exemplary atomizer includes a liquid supply, a mouthpiece at a first end of the liquid supply, an air pipe, a liquid supply, and an atomizing device at an opposite second end. The atomizing device includes a main body, a liquid conducting element, and a heating element. The main body has an atomizing chamber. The liquid supply defines at least one air inlet at the first end. The air pipe and the liquid supply cooperatively define an annular air passage. The main body defines at least one liquid inlet and at least one air hole. The air passage is in communication with the atomizing chamber via the at least one air hole. The liquid supply has a housing, and the housing defines liquid outlets. The liquid outlets communicates with the at least one liquid inlet, and the liquid conducting element is configured for absorbing the tobacco liquid.

10 Claims, 5 Drawing Sheets

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

A typical atomizer for an electronic cigarette defines a liquid chamber inside for storing tobacco liquid. The atomizer includes a first end and an opposite second end. The mouthpiece is arranged at the first end. The second end defines at least one air inlet. However, the tobacco liquid may leak from the at least one air inlet in use or transportation, thus rendering user experience unsatisfactory.

What are needed, therefore, are an atomizer and an electronic cigarette using same, which can overcome the above shortcomings.

SUMMARY

An exemplary atomizer includes a liquid supply, a mouthpiece at a first end of the liquid supply, an air pipe, a liquid supply, and an atomizing device at an opposite second end. The atomizing device includes a main body, a liquid conducting element, and a heating element. The main body has an atomizing chamber. The liquid supply defines at least one air inlet at the first end. The air pipe and the liquid supply cooperatively define an annular air passage. The main body defines at least one liquid inlet and at least one air hole. The air passage is in communication with the atomizing chamber via the at least one air hole. The liquid supply has a housing, and the housing defines liquid outlets. The liquid outlets communicates with the at least one liquid inlet, and the liquid conducting element is configured for absorbing the tobacco liquid.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
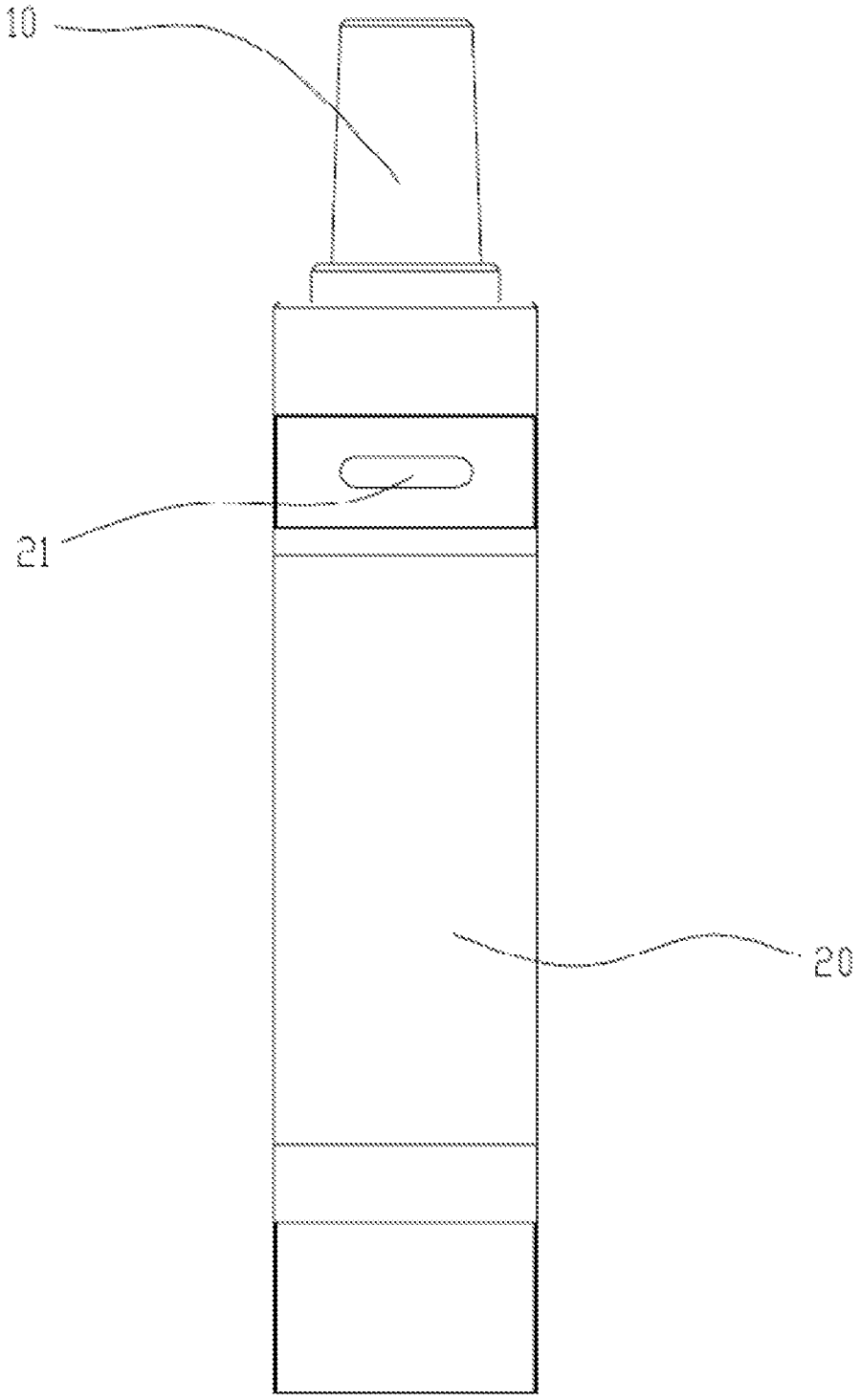
FIG. 1 is a side view of an atomizer according to an embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
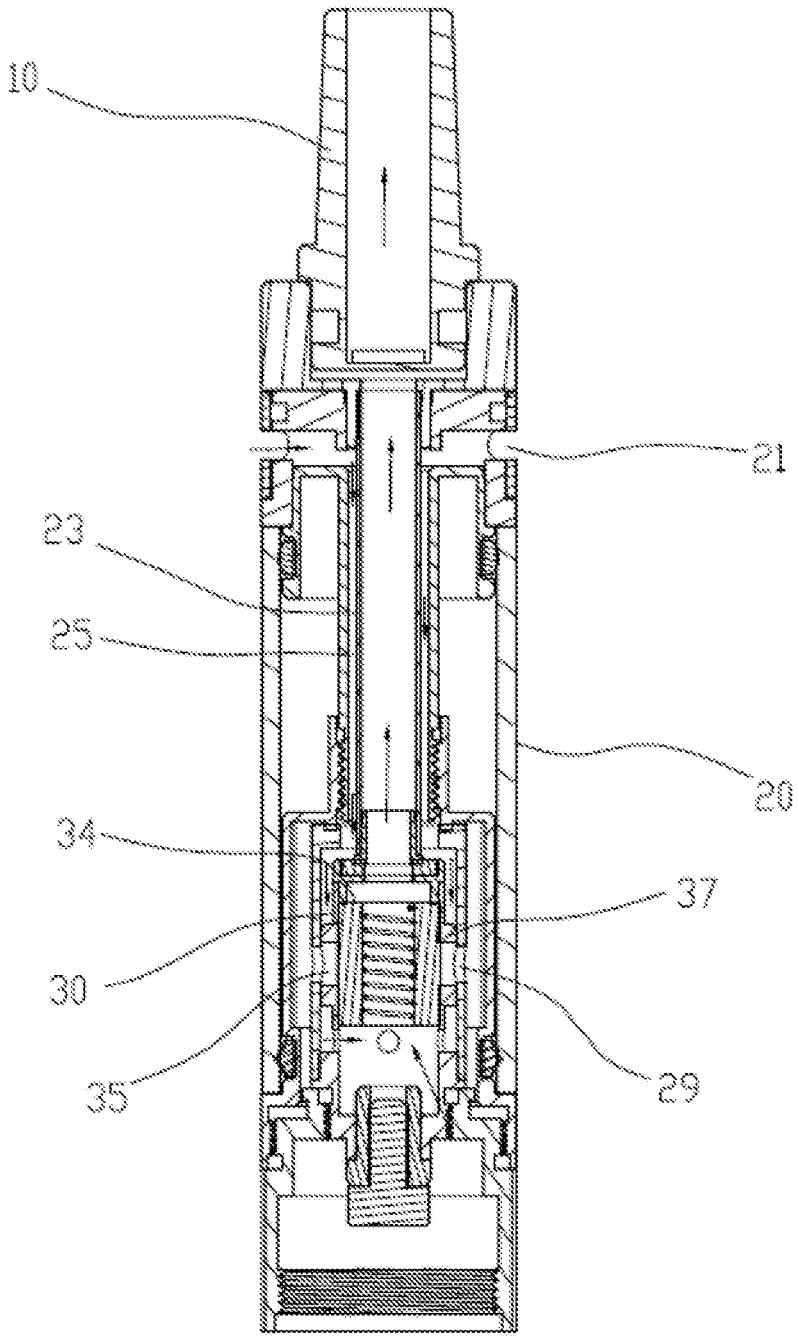
FIG. 2 is a side cross-sectional view of the atomizer of FIG. 1.
Figure 3:
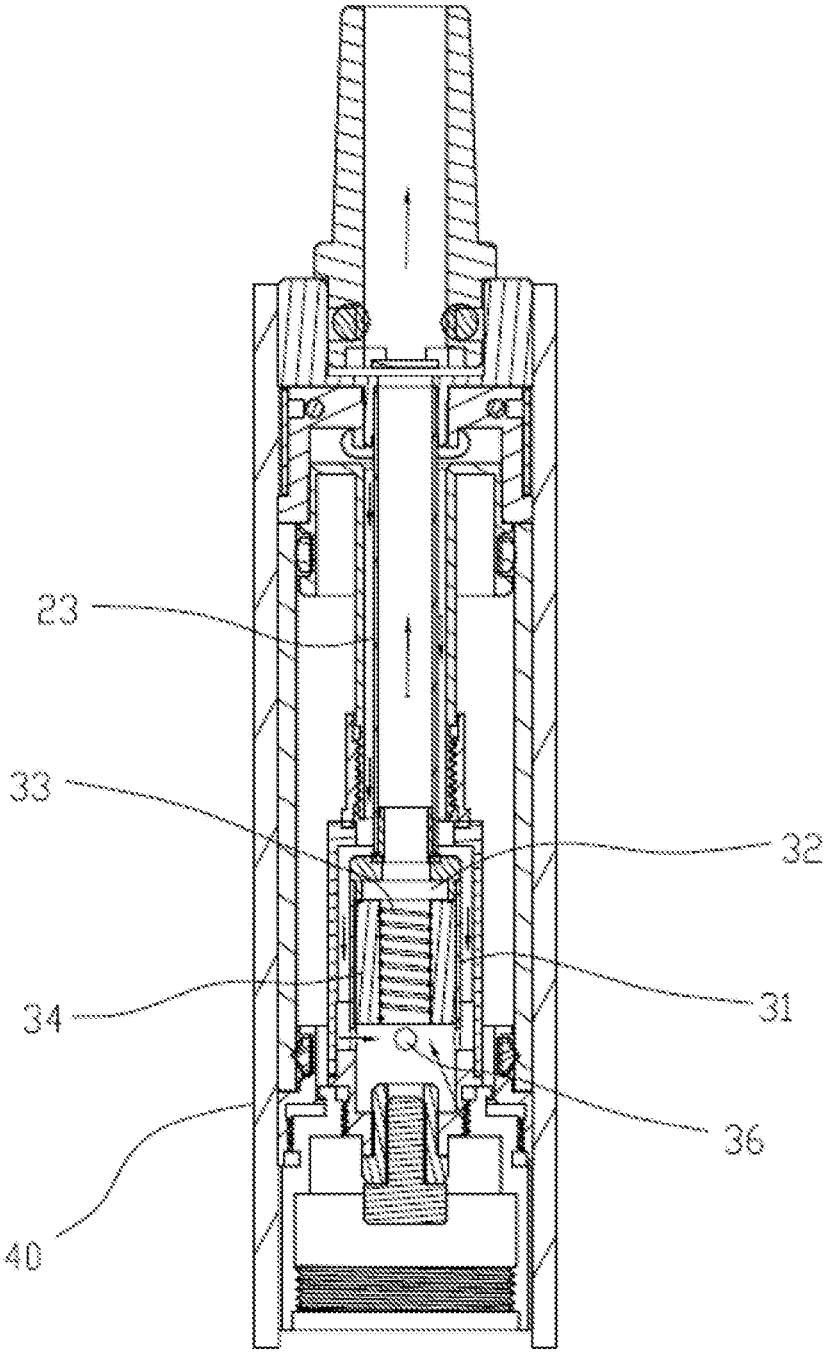
FIG. 3 is another cross-sectional view of the atomizer of FIG. 1, with a sleeve.

Referring to FIGS. 1-3, an atomizer 100 for an electronic cigarette is shown. The atomizer 100 includes a liquid supply 20 configured (i.e., structured and arranged) for storing tobacco liquid, a mouthpiece 10, and an atomizing device 30. The mouthpiece 10 and the atomizing device 30 are arranged at two opposite ends of the liquid supply 20. The atomizing device 30 includes a main body 31 having an atomizing chamber 32, a liquid conducting element 34 in the atomizing chamber 32, and a heating element 33 in contact with the liquid conducting element 34. An air pipe 23 is provided between the atomizing device 30 and the mouthpiece 10, and configured for communicating the atomizing chamber 32 and the mouthpiece 10. The liquid supply 20 defines two air inlets 21 at an end adjacent to the mouthpiece. The air pipe 23 and the liquid supply 20 cooperatively define an annular air passage 25, which is in communication with the air inlets 21. In the present embodiment, the main body 31 defines two liquid inlets 35 and four air holes 36. The air passage 25 is in communication with the atomizing chamber 32 via the air holes 36. The liquid supply 20 defines liquid outlets 29 matching with the liquid inlets 35. A part of the main body 31 with the liquid inlets 35 is tightly engaged with a housing of the liquid supply 20, thus avoiding liquid leakage. In the present embodiment, the main body 31 and the housing of the liquid supply 20 are coupled by interference fit. The liquid outlets 29 communicate with the liquid inlets 35. The tobacco liquid in the liquid supply 20 flows through the liquid outlets 29, the liquid inlets 35, and then reaches the liquid conducting element 34. In use, aerosol generated by the atomizing device 30 reaches a mouth of the user through the air pipe 23.

In the present embodiment, the mouthpiece 10 and the air inlets 21 are arranged at the same end of the liquid supply, and the atomizing device 30 is positioned at the other end of the liquid supply 20. Therefore, air from outside enters the air inlets 21, passes the annular air passage 25, and then reaches the atomizing device 30. Finally, the air and aerosol in the atomizing device 30 are expelled from the air pipe 23 via the mouthpiece 10. Accordingly, tobacco liquid, which leaks out from the atomizing device 30 or remains in the atomizing device 30, will not leak easily from the air inlets 21.

Figure 4:
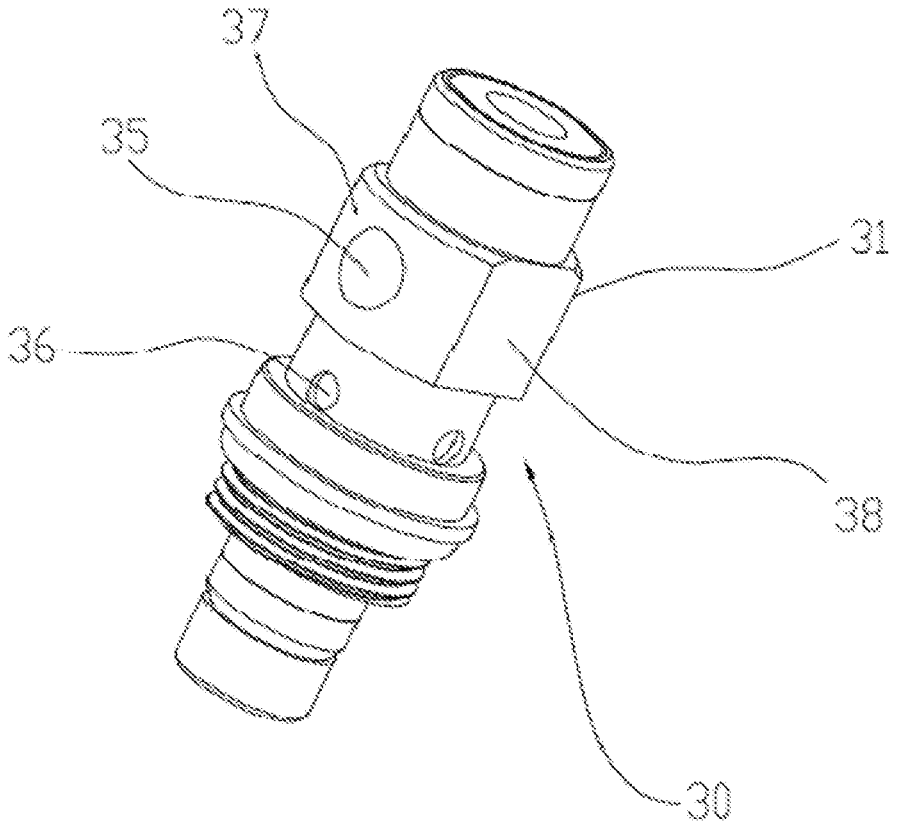
FIG. 4 is a perspective view of an atomizing device.

Referring to FIG. 4, the main body 31 includes two protrusions 37. The two protrusions 37 protrude into the air passage 25, and are coupled to the housing of the liquid supply 20 by interference fit. The liquid inlets 35 are defined in a respective protrusion 37 in a one-to-one relationship.

Referring to FIGS. 3-4, the air holes 36 are positioned below the liquid inlets 35 along an axial direction of the main body 31. External air enters the air inlets 21, passes through the air passage 25, gaps 38 between the protrusions 37, the air holes 36, and then reaches the atomizing chamber 32. In the present embodiment, the liquid conducting element 34 is made of cotton, glass fiber, or ceramic material. The heating element 33 is oriented along a direction parallel to the axial direction of the main body 31. The liquid conducting element 34 is configured for absorbing tobacco liquid flowed in from the liquid inlets 35.

Referring to FIG. 2, the air pipe 23 is sleeved in the liquid conducting element 20, and a gap formed between the air pipe 23 and the liquid supply 20, serves as the above air passage 25. The liquid conducting element 20 is made of transparent material.

It is noted that, in other embodiments, the heating element 33 may be oriented in a direction perpendicular to an axial direction of the main body 31.

It is to be understood that, in other embodiments, a casing tube 40 may be further provided for ornament use. The liquid supply 20 and the atomizing device 30 are nested in the casing tube 40.

Figure 5:
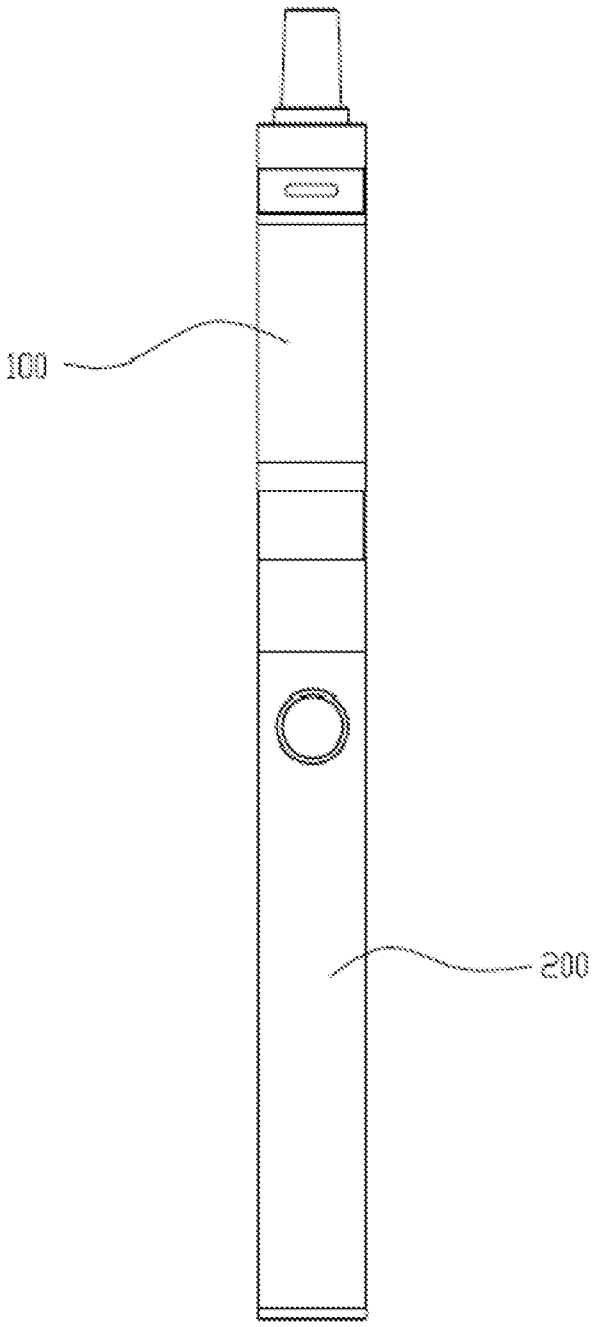
FIG. 5 is a side view of an electronic cigarette according to an embodiment.

Referring to FIG. 5, an electronic cigarette includes the atomizer 100 according to the first embodiment, and a power supply 200. The atomizer 100 and the power supply 200 are coupled with each other by screw threads. The power supply 200 is configured for supplying the atomizer 100 power.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

a liquid supply configured for storing tobacco liquid;

a mouthpiece at a first end of the liquid supply;

an air pipe;

an atomizing device at an opposite second end, the atomizing device comprising:

a main body having an atomizing chamber, the air pipe connecting the atomizing chamber and the mouthpiece;

a liquid conducting element in the atomizing chamber; and a heating element in contact with the liquid conducting element;

wherein the liquid supply defines at least one air inlet at the first end, the air pipe and the liquid supply cooperatively define an annular air passage, the air passage is in communication with the air inlet, the main body defines at least one liquid inlet and at least one air hole, the air passage is in communication with the atomizing chamber via the at least one air hole, the liquid supply has a housing, the housing defines liquid outlets matching with the at least one liquid inlet, the liquid outlets communicates with the at least one liquid inlet, and the liquid conducting element is configured for absorbing the tobacco liquid flowed through the liquid outlets and the at least one liquid inlet from the liquid supply.

2. The atomizer according to claim 1, wherein the liquid conducting element is made of cotton, glass fiber or ceramic material.

3. The atomizer according to claim 1, wherein the heating element is oriented along a direction parallel to an axial direction of the main body.

4. The atomizer according to claim 1, wherein the heating element is oriented along a direction perpendicular to an axial direction of the main body.

5. The atomizer according to claim 1, wherein the air pipe is nested in the liquid supply, the air pipe and the liquid supply cooperatively define a gap therebetween, and the gap serves as the air passage.

6. The atomizer according to claim 1, wherein the liquid supply is made of transparent material.

7. The atomizer according to claim 1, further comprising a casing tube nesting the liquid supply and the atomizing device.

8. An electronic cigarette, comprising:

an atomizer according to claim 1; and a power supply configured for supplying the atomizer power.

9. The atomizer according to claim 1, wherein the main body comprises at least one protrusion, the at least one protrusion protrudes into the air passage, the at least one protrusion is coupled with the housing of the liquid supply by interference fit, and the at least one liquid inlet is defined in a corresponding protrusion.

10. The atomizer according to claim 9, wherein the at least one air hole is positioned below the at least one liquid inlet, external air enters the at least one air inlet, then passes the air passage, the at least one air hole, and reaches the atomizing chamber.

* * * * *